US006279332B1

(12) United States Patent
Yeo et al.

(10) Patent No.: US 6,279,332 B1
(45) Date of Patent: Aug. 28, 2001

(54) PERFORMANCE TESTING METHOD OF AIR CONDITIONER

(75) Inventors: Young-Gil Yeo, Youngin; Jae-Seok Cho, Suwon, both of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/593,160

(22) Filed: Jun. 14, 2000

(30) Foreign Application Priority Data

Aug. 5, 1999 (KR) ..... 99-32128

(51) Int. Cl.[7] ..... F25B 49/02

(52) U.S. Cl. ..... 62/125; 62/127; 62/129; 62/298

(58) Field of Search ..... 62/125, 126, 127, 62/129, 237, 298, 299

(56) References Cited

U.S. PATENT DOCUMENTS 4,526,010 7/1985 Sato et al. ..... 62/126
4,862,698 * 9/1989 Morgan et al. ..... 62/125 X
5,142,876 * 9/1992 Snider et al. ..... 62/298 X
5,191,770 3/1993 Kim ..... 62/263
5,203,178 4/1993 Shyu ..... 62/180
5,307,643 * 5/1994 Beckerman ..... 62/298 X
5,824,921 10/1998 Kanai ..... 73/865.8

* cited by examiner

*Primary Examiner*—Harry B. Tanner
(74) *Attorney, Agent, or Firm*—Robert E. Bushnell, Esq.

(57) ABSTRACT

A performance testing method of air conditioner, adapted to simultaneously test performance of indoor units and outdoor units on a production line for concurrently assembling the indoor units and outdoor units, the method comprising the steps of: firstly testing operability of indoor unit and leakage of outdoor units; connecting a communication line between the indoor unit and the outdoor unit; connecting a pipe between the outdoor unit and a dummy indoor unit; secondly testing a communicative operation between the indoor unit and the outdoor unit and operability of the outdoor unit; and comprehensively discriminating performances of the indoor unit and outdoor unit according to test data disclosed from the first and second testing procedures.

17 Claims, 4 Drawing Sheets

PERFORMANCE TESTING METHOD OF AIR CONDITIONER

CLAIM OF PRIORITY

This application makes reference to, incorporates the same herein, and claims all benefits accruing under 35 U.S.C. §119 from an application for Performance Testing Method of Air Conditioner earlier filed in the Korean Industrial Property Office on Aug. $5^{th}$ 1999 and there duly assigned Ser. No. 32128/1999.

BACKGROUND OF THE INVENTION

1. Field of the Invention

The present invention relates to a separation-type air conditioner, and more particularly to a performance testing method of air conditioner adapted to simultaneously test performance of indoor units and outdoor units on a production line for simultaneously assembling the indoor units and outdoor units.

2. Description of the Prior Art

Generally, a separation-type air conditioner includes an indoor unit and an outdoor unit, where, between the indoor unit and the outdoor unit, there is a communication line for reciprocally receiving and transmitting data of operation state (temperature, humidity, outside temperature, operational frequency, motor revolutions per minute of each indoor unit, etc) and a refrigerant pipe for infusing and discharging refrigerant.

A conventional production line for assembling a separation-type air conditioner having a separate indoor unit and outdoor unit is separately equipped with an indoor unit line for assembling the indoor unit and an outdoor unit line for assembling the outdoor unit, and the indoor and outdoor unit lines are respectively mounted with testing systems for checking whether the quality of each set is good or bad.

In the conventional production line where the indoor units and outdoor units are separately assembled, a test system of the indoor unit line sequentially performs each test of an indoor unit and comprehensively analyzes the data therefrom to inspect the performance (good or bad quality) of the indoor unit, while a test system of the outdoor unit line sequentially performs each test of the outdoor unit and comprehensively analyzes the data therefrom to inspect the performance (good or bad quality) of the outdoor unit.

However, there is a problem in the performance test method of separation-type air conditioner according to the prior art thus described in that production lines are separately installed for the indoor units and the outdoor units, inevitably forcing tests to be done separately for the indoor units and the outdoor units, thereby prolonging an operation time. There is another problem in that investment cost is increased due to overlapped systems. There is still another problem in that in separate testing of indoor units and outdoor units, it is difficult to correctly discriminate the capacity of cooling and heating which results from circulation of coolant flowing between the indoor unit and the outdoor unit.

Examples of separation-type air conditioners of the conventional art are seen, for example, in the following U.S. Patents. U.S. Pat. No. 4,526,010, to Sato et al., entitled Separation Type Air Conditioner, describes an air conditioner with indoor, outer and remote controller units at different locations.

U.S. Pat. No. 5,191,770, to Kim, entitled Mounting Assembly Of A Separate Type Air-Conditioner, describes an air conditioner with separate indoor and outdoor units affixed to opposite sides of a building wall.

U.S. Pat. No. 5,203,178, to Shyu, entitled Noise Control Of Air Conditioner, describes an air conditioning apparatus which performs a test to determine optimum speeds of the motors of the apparatus, to minimize vibration.

U.S. Pat. No. 5,824,921, to Kanai, entitled Method And System For Testing Performance Of Refrigeration Units, describes an assembly line having a test line capable of operating an air conditioner in a simulation mode and measuring a physical quantity in this simulation mode. The patent describes testing of the outdoor unit of a separate type air conditioner.

SUMMARY OF THE INVENTION

It is therefore an object of the present invention to provide an improved performance testing method of a separation-type air conditioner.

It is a further object of the present invention to provide a more rapid performance testing method of a separation-type air conditioner.

A yet further object of the present invention to provide a performance testing apparatus of a separation-type air conditioner, of lower capital cost.

A still further object of the present invention is to provide a performance testing apparatus and method which can correctly discriminate the cooling and heating capacity of indoor and outdoor units of the air conditioner.

The present invention is disclosed to achieve the above and other objects of the present invention by providing a performance testing method of an air conditioner adapted to simultaneously test performances of indoor units and outdoor units on a production line for simultaneous assembly of the indoor units and the outdoor units, thereby shortening operation time. The present invention reduces investment cost by using a single system. The present invention simultaneously tests the indoor units and outdoor units to thereby increase discrimination capacity.

In accordance with the objects of the present invention, there is provided a performance testing method of air conditioner, the method comprising the steps of:

firstly testing operability of indoor unit and leakage of outdoor units;

connecting a communication line between the indoor unit and the outdoor unit;

connecting a pipe between the outdoor unit and a dummy indoor unit;

secondly testing a communicative operation between the indoor unit and the outdoor unit and operability of the outdoor unit; and comprehensively discriminating performances of the indoor unit and outdoor unit according to test data disclosed from the first and second testing procedures.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
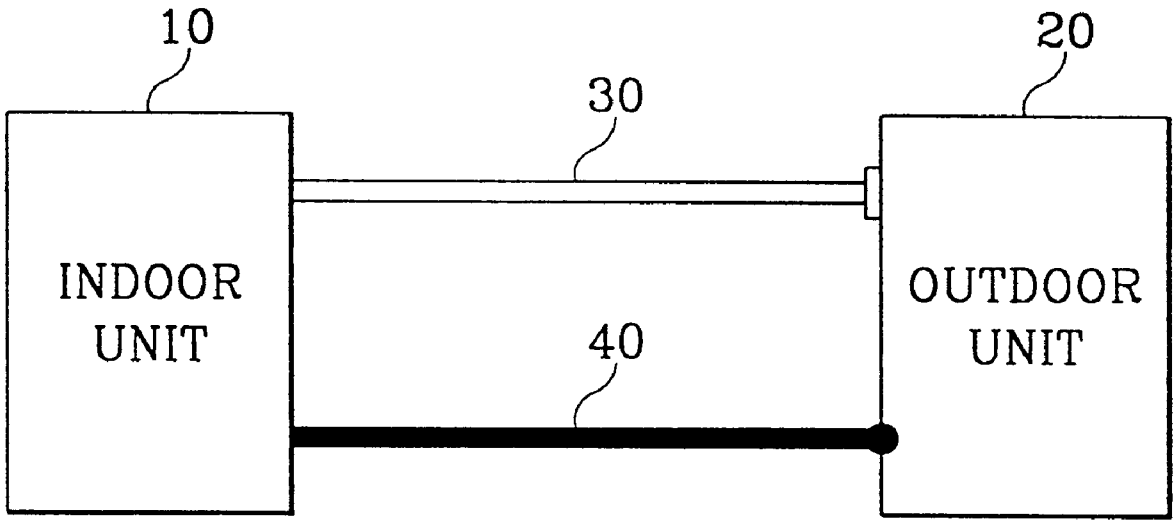
FIG.1 (PRIOR ART)
FIG. 1 is a schematic diagram of indoor unit and outdoor unit of a general separation-type air conditioner.

Turning now to the drawings, the general separation-type air conditioner described above includes, as illustrated in FIG. 1, an indoor unit 10 and an outdoor unit 20, where, between the indoor unit 10 and the outdoor unit 20, there is a communication line 30 for reciprocally receiving and transmitting data of operation state (temperature, humidity, outside temperature, operational frequency, motor revolutions per minute of each indoor unit, etc) and a refrigerant pipe 40 for infusing and discharging refrigerant.

A conventional production line for assembling a separation-type air conditioner having a separate indoor unit 10 and outdoor unit 20 is separately equipped with an indoor unit line for assembling the indoor unit 10 and an outdoor unit line for assembling the outdoor unit 20, and the indoor and outdoor unit lines are respectively mounted with testing systems for checking whether the quality of each set is good or bad.

In the conventional production line where the indoor units 10 and outdoor units 20 are separately assembled, a test system of the indoor unit line sequentially performs each test of an indoor unit 10 and comprehensively analyzes the data therefrom to inspect the performance (good or bad quality) of the indoor unit 10, while a test system of the outdoor unit line sequentially performs each test of the outdoor unit 10 and comprehensively analyzes the data therefrom to inspect the performance (good or bad quality) of the outdoor unit 20.

However, there is a problem in the performance test method of separation-type air conditioner according to the prior art thus described in that production lines are separately installed for indoor units 10 and the outdoor units 20 inevitably forcing tests to be done separately for the indoor units 10 and the outdoor units 20, thereby prolonging an operation time. There is another problem in that investment cost is increased due to overlapped systems. There is still another problem in that in separate testing of indoor units 10 and outdoor units 20, it is difficult to correctly discriminate the capacity of cooling and heating which results from circulation of coolant flowing between the indoor unit and the outdoor unit.

A preferred embodiment of the present invention will now be described in detail with reference to the accompanying drawings. Throughout the drawings, like reference numerals and terms are used for designation of like or equivalent parts or portions for simplicity of illustration and explanation.

Figure 2:
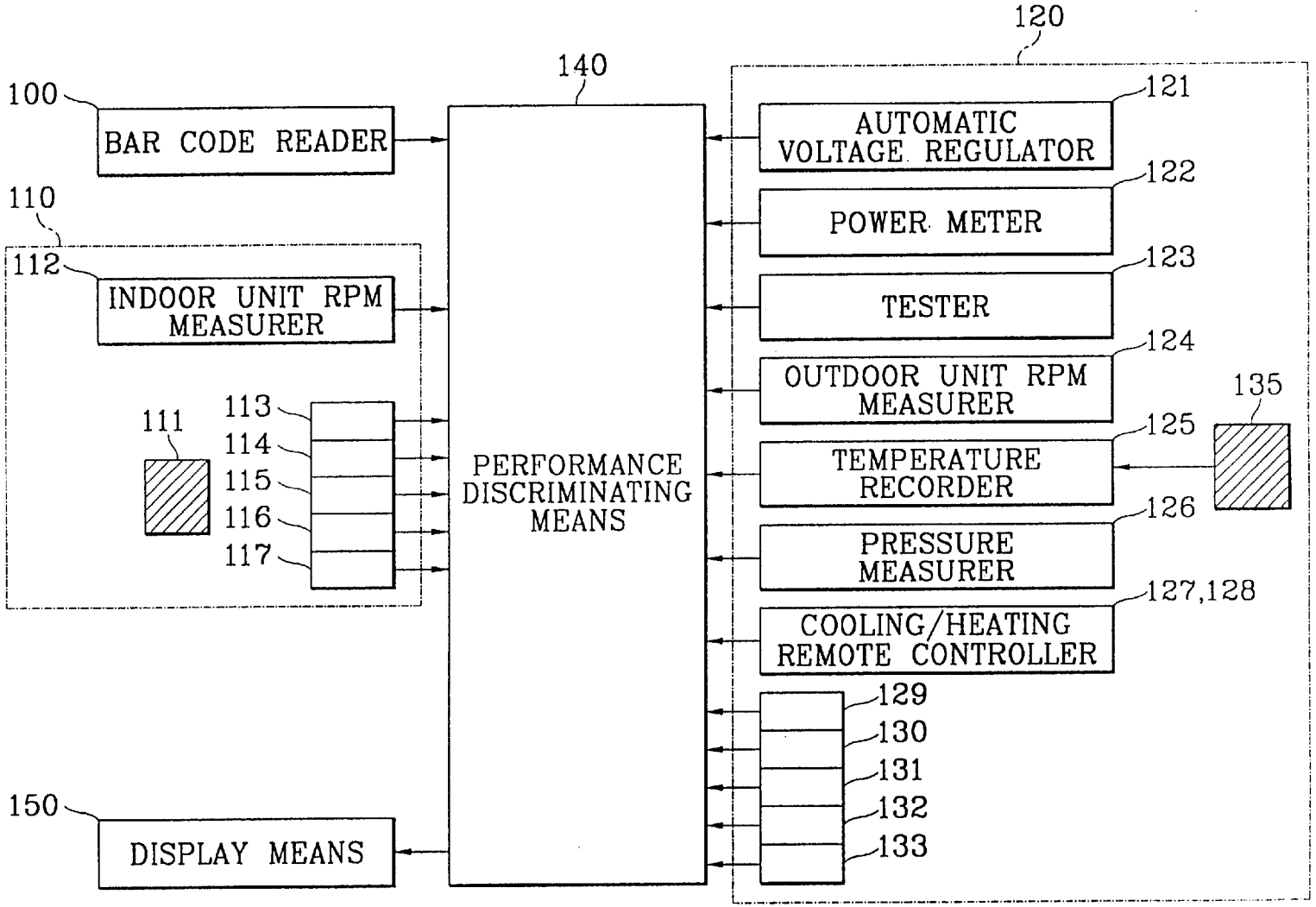
FIG. 2 is a block diagram for illustrating a performance testing device of air conditioner according to an embodiment of the present invention.

A performance testing device of air conditioner for testing performance of indoor units 10 and outdoor units 20 simultaneously put into testing procedure at a production line for concurrently assembling the indoor units 10 and outdoor units 20 includes, as illustrated in FIG. 2, a bar code reader 100 for reading a bar code of a set (an indoor unit and an outdoor unit) put into the testing procedure, first test procedure means 110 for testing operability of the indoor unit 10 and gas leakage of the outdoor unit 20, second test procedure means 120 for connecting a communication line between the indoor unit 10 and the outdoor unit 20 and connecting a pipe between the outdoor unit 20 and a dummy indoor unit for testing cooling, heating, communication and operability of the outdoor unit 20, and performance discriminating means 140 for analyzing data of test set (indoor unit+outdoor unit) as identified by the bar code input from the bar code reader 100 and receiving a test signal output from the first test procedure means 110 or second test procedure means 120 to sequentially process each test of the test set and to comprehensively analyze and discriminate the data, thereby discriminating a good quality or bad quality of the test set, where display means 150 is additionally mounted thereto for displaying good quality or bad quality of the test set according to control signal output from the performance discriminating means 140, thereby allowing a worker to easily discriminate performance of the indoor unit 10 and the outdoor unit 20.

The first test procedure means 110 includes a gas detector 111 for detecting refrigerant gas of the outdoor unit 20, an indoor RPM measurer 112 for measuring the revolution rate (RPM) of a motor in the indoor unit 10, a gas leakage switch, or input device, 113 for manual input of a signal indicating leakage by a worker to checking leakage of gas detected by the gas detector 111, an operation switch, or input unit, 114 for manual input of an abnormal (bad) operational signal by a worker checking the operational state of the indoor unit 10 (fan, louver, lamp, buzzer and the like), an abnormal room noise switch, or input unit, 115 for manual input of bad noise signal by a worker checking the noise state of the indoor unit 10, and start/end switches 116 and 117 for allowing a worker to manually input signals of test start and test completion of the first test procedure means 110. These input units may be, for example, an input unit or key board electrically connected to performance means 140.

The second test procedure means 120 includes an automatic voltage regulator 121 for restricting the changes of power voltage to generate static voltage and low voltage. An automatic voltage regulator is a device for preventing damage to equipment by load due to the generation of overvoltage or low voltage, and for maintaining stability by way of constant voltage. Second test procedure means 120 also includes a power meter 122 for measuring input voltage, current and consumed electricity, a tester 123 for testing voltage resistance, insulation resistance and earthing (grounding) resistance, an outdoor RPM tester 124 for measuring revolutions per minute of a motor in the outdoor unit 20, a temperature recorder 125 for measuring a temperature difference between an inlet and outlet of dummy indoor unit 135, a pressure tester 126 for measuring pipe pressure, cooling/heating remote controllers 127 and 128 for cooling or heating the test set, a bad heating switch 129 for manually inputting an "abnormal/bad heating" signal when a worker checks a heating condition when turning on the heating remote controller 128, an abnormal outdoor noise switch 130 for manual input of an abnormal noise signal by a worker checking a noise condition of the outdoor unit 20, a bad communication switch 131 for manual input of an abnormal (bad) communication signal by a worker checking a communication condition between the indoor unit 10 and the outdoor unit 20, and start/end switches 132 and 133 for allowing a worker to manually input signals of test start/end of the second test procedure means 120.

Figure 3A:
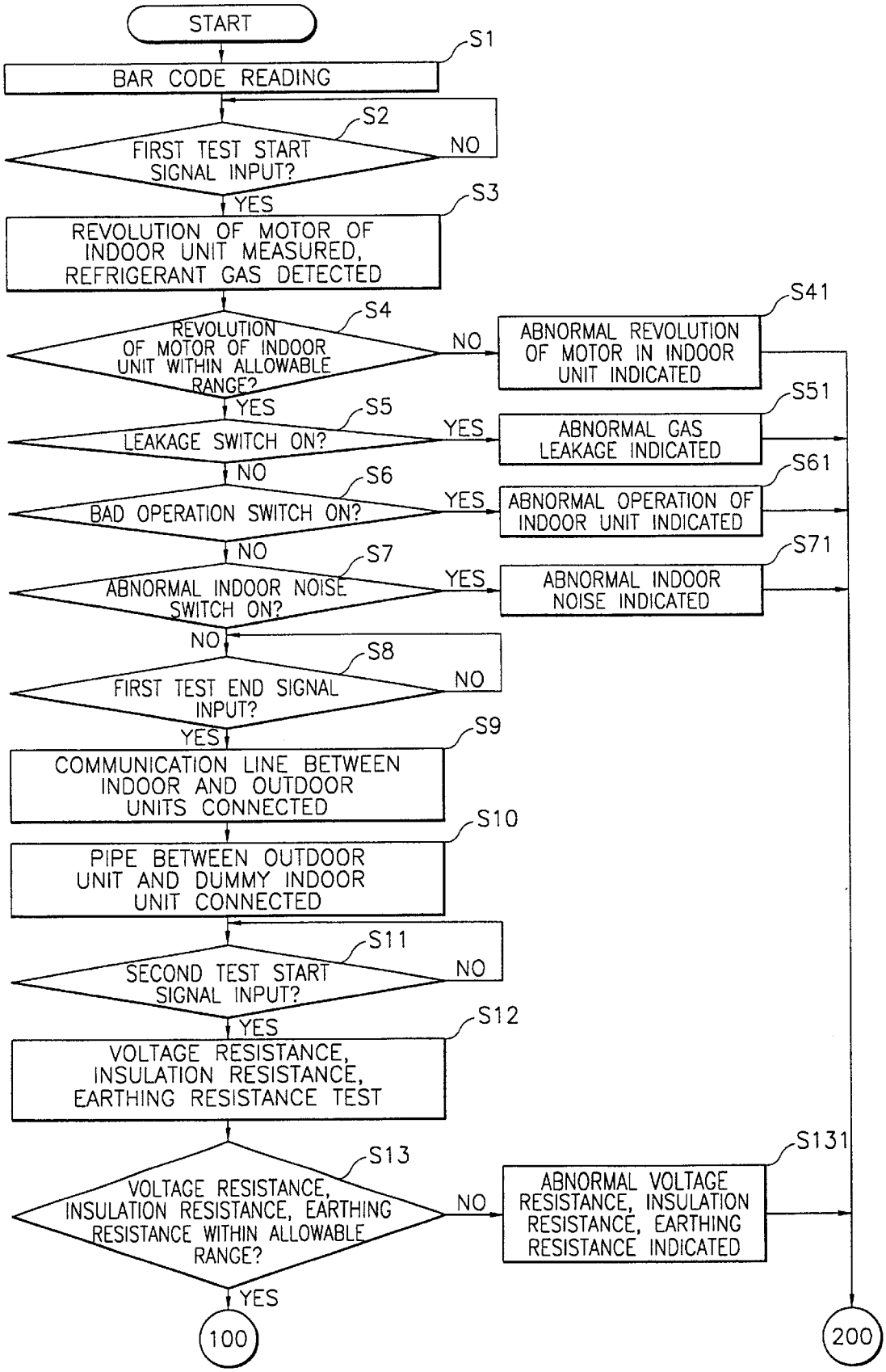
FIGS. 3*a* and 3*b* are flow charts for respectively illustrating a performance test control operational procedure of air conditioner according to the present invention.
Figure 3B:
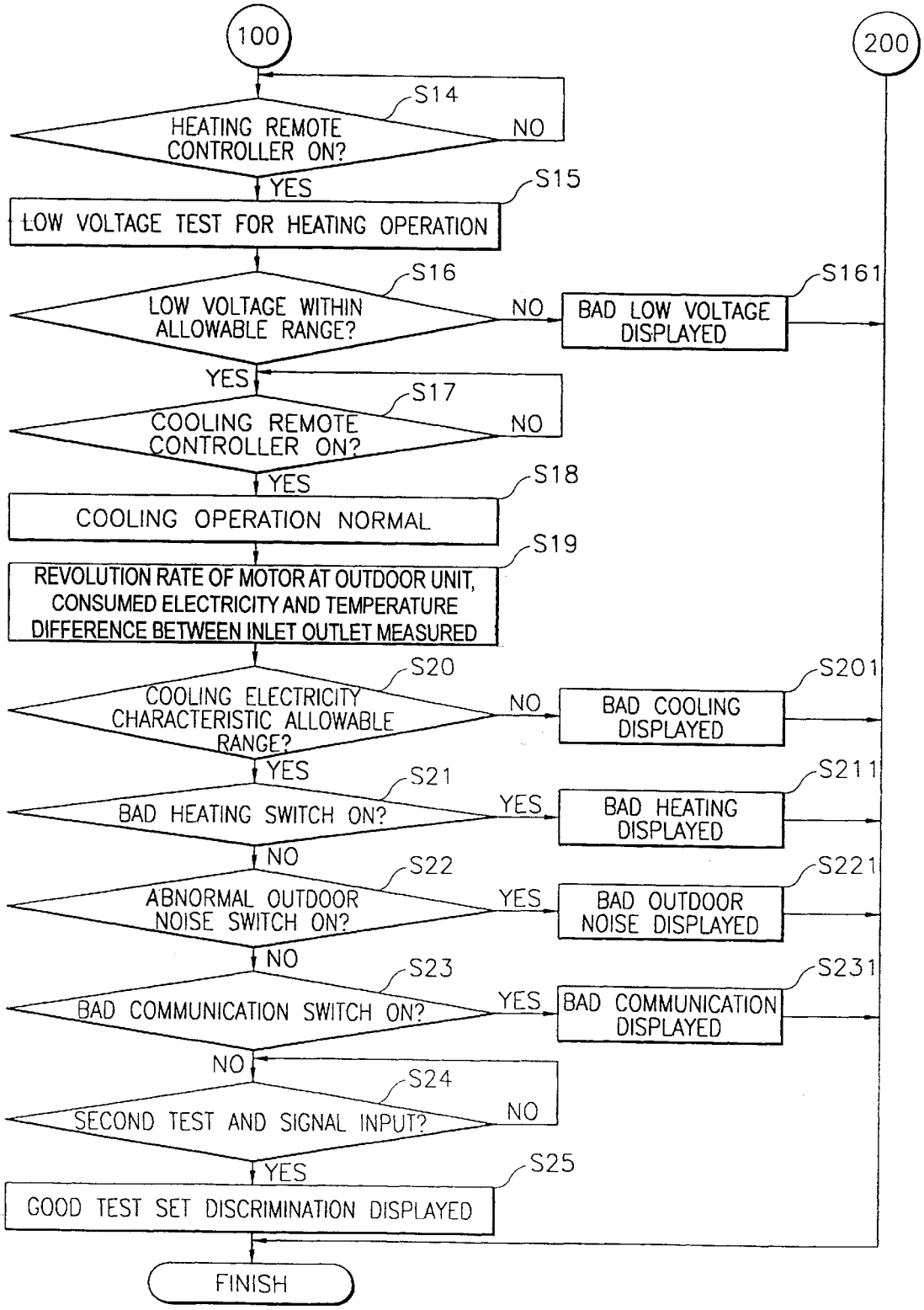

Now, the operational effect of the performance test method of air conditioner thus constructed according to the present invention will be described. FIGS. 3*a* and 3*b* are flow charts for illustrating operation procedures of performance test control for an air conditioner according to the present invention, where reference symbol S indicates step.

First of all, when an indoor unit 10 and an outdoor unit 20 are concurrently assembled and put into test procedure, at step S1, the bar code reader 100 reads a bar code of a set (indoor unit+outdoor unit) put to the test procedure to thereafter input the bar code data to the performance discriminating means 140, which in turn analyzes the data of the test set (indoor unit+outdoor unit) as identified by the bar code input from the bar code reader 100.

Successively, at step S2, a worker manually manipulates the start switch 116 of the first test procedure means 110 to allow the performance discriminating means 140 to discriminate whether a first test start signal is input, and if the first test start signal is not input (that is, NO at step S2), the method repeatedly performs step S2. As a result of the discrimination at step S2, if the first test start signal is input (YES at S2), flow of the method advances to step S3 to start each test of the first test procedure means 110, where the gas detector 111 at the first test procedure means 110 detects the refrigerant gas of the outdoor unit 20 and the indoor RPM measurer 112 measures the revolution rate of a motor in the indoor unit 10 to input the measured data to the performance discriminating means 140.

Successively, at step S4, the performance discriminating means 140 compares the revolution rate of the motor of indoor unit 10 measured by the indoor RPM measurer 112 with the established revolutions per minute of test set identified by bar code to discriminate whether the revolution rate of the motor in the indoor unit 10 is within the allowable range, and if the revolution rate is not within the allowable range (NO at S41), flow of the method advances to step S41, where the performance discriminating means 140 discriminates that the revolution rate of the motor in the indoor unit 10 is bad and causes the display means 150 to indicate that the revolution rate of the motor in the indoor unit 10 is bad, thereby terminating the operation (discharge of the set).

As a result of the discrimination at step S4, if the revolution rate of the motor in the indoor unit 10 is within the allowable range (that is, YES at step S4), flow of the method proceeds to step S5, where a worker checks if there is any leakage of gas from the gas detector 111 and the performance discriminating means discriminates whether the gas leakage switch 113 has been manually turned on as a result of the discrimination at step S5, and if the gas leakage switch 113 is turned on (YES at step S5), flow of the method advances to step S51, where the performance discriminating means 140 discriminates that gas is leaking, and causes the display means 150 to indicate "the gas is leaking" to terminate the operation.

Meanwhile, as a result of the discrimination at step S5, if the gas leakage switch 113 is not turned on (that is, NO at step S5), flow of the method proceeds to step S6 to allow a worker to check an operational status of the indoor unit 10 (fan, louver, lamp, buzzer, etc) and performance discriminating means 140 discriminates whether the operation switch 114 is manually turned on. As a result of the discrimination at step S6, if the operation switch 114 is turned on (YES at step S6), flow of the method advances to step S61, where the performance discriminating means 140 discriminates that the indoor unit 10 is inoperable and causes the display means 150 to indicate that the indoor unit 10 is inoperable and to terminate the operation.

Meanwhile, as a result of the discrimination at step S6, if the operation switch 114 is not turned on (NO at step S6), flow of the method proceeds to step S7, where a worker checks noise state of the indoor unit 10 to decide whether to manually operate the abnormal room noise switch 115. As a result of the discrimination at step S7, if the abnormal room noise switch 115 is turned on (YES in step S7), flow of the method proceeds to step S71, where the performance discriminating means 140 discriminates that the indoor unit 10 is bad in terms of noise state and thereby causes the display means 150 to indicate that the indoor unit 10 is bad in noise state, and terminates the operation.

Meanwhile, as a result of the discrimination at step S7, if the abnormal room noise switch 115 is not turned on (in case of NO), flow of the method advances to step S8, where a worker manually manipulates the end switch 117 of the first test procedure means 110 to determine whether a first test end signal is input to the performance discriminating means 140, and if the signal is not input (that is, in case of NO), step S8 is repeated.

As a result of the discrimination at step S8, if the first test end signal is input (in case of YES), flow of the method advances to step S9 because each test at the first test procedure means 110 has been sequentially progressed through and completed. At step S9 a worker connects a communication cable between the indoor unit 10 put into the second test procedure means 120 and the outdoor unit 20. Flow of the method now advances to step S10 where a pipe is connected between the outdoor unit 20 and the dummy indoor unit 135.

Successively, at step S11, a worker decides whether to manually turn on the start switch 132 of the second test procedure means 120 and performance discriminating means 140 discriminates whether a second test start signal has been input, and if the second test start signal is not input (NO in S11), step S11 is repeated.

As a result of discrimination at step S11, if the second test start signal is input (YES in step S11), flow of the method proceeds to step S12 because each test of the second test procedure means 120 should be started, where the tester 123 at the second test procedure means 120 tests voltage resistance, insulation resistance, earthing resistance to input the test values to the performance discriminating means 140.

Successively, at step S13, the performance discriminating means 140 compares the voltage resistance, insulation resistance and earthing resistance detected by the tester 123 with the voltage resistance, insulation resistance and earthing resistance set-up value identified by the bar code to discriminate whether the voltage resistance, insulation resistance and earthing resistance are within the allowable limit.

As a result of the discrimination at step S13, if the voltage resistance, insulation resistance and earthing resistance are not in the allowable range (NO in step S13), flow of the method proceeds to step S131, where the performance discriminating means 140 discriminates that the voltage resistance, insulation resistance and earthing resistance are bad to allow the display means 150 to indicate that the voltage resistance, insulation resistance and earthing resistance are bad, thereby terminating the operation.

Meanwhile, as a result of the discrimination at step S13, if the voltage resistance, insulation resistance and earthing resistances are good (YES at step S13), flow of the method advances to step S14, where the worker discriminates whether the cooling remote controller 128 is manually turned on, and if the heating remote controller 128 is not turned on (in case of NO), step S14 is repeatedly performed.

As a result of the discrimination at step S14, if the heating remote controller 128 is turned on (in case of YES), flow of the method proceeds to step S15, where the performance discriminating means 140 tests a low voltage generated from the automatic voltage regulator 121 at the second test procedure means 120 during the heating operation.

Successively, at step S16, the performance discriminating means 140 compares the tested low voltage with the low voltage set-up value analyzed by the bar code to discriminate whether the low voltage is within the allowable limit.

If the low voltage is not within the allowable range (in case of NO), flow of the method advances to step S161, where the performance discriminating means 140 discriminates that the low voltage is bad to cause the display means 150 to indicate that the low voltage is bad, thereby terminating operation.

As a result of the discrimination at step S16, if the low voltage is within the allowable range (YES at step S16), flow of the method proceeds to step S17, where the worker discriminates whether the cooling remote controller 127 is manually turned on, and if the cooling remote controller 127 is not turned on (in case of NO), step S17 is repeatedly performed.

As a result of discrimination at step S17, if the cooling remote controller 127 is turned on (in case of YES), flow of the method proceeds to step S18, where the performance discriminating means 140 performs a normal cooling operation. At this time, at step S19, the outdoor RPM measurer 124 of the second test procedure means 120 measures the revolutions per minute of the motor in the outdoor unit 20, and the power meter 122 measures consumed power, while the temperature recorder 125 measures a temperature difference between inlet and outlet of the dummy indoor unit 135 disposed in the second test procedure means 120 to record same.

Successively, at step S20, the performance discriminating means 140 compares the consumed power measured by the power meter 122 with consumed power set-up value recorded for this bar code value, while the temperature recorder 125 compares the temperature difference between inlet and outlet of the dummy indoor unit measured by the temperature recorder 125 with the temperature difference set-up value recorded for this bar code value, to discriminate whether the cooling electricity characteristic is within an allowable range.

As a result of the discrimination at step S20, if the cooling electricity characteristic is not within the allowable range (in case of NO), flow of the method proceeds to step S201, where the performance discriminating means 140 discriminates that cooling is bad to cause the display means 150 to indicate that the cooling is bad and to stop operation.

Meanwhile, as a result of the discrimination at step S20, if the cooling electricity characteristic is within the allowable range (in case of YES), flow of the method advances to step S21, where the worker checks the heating status to discriminate whether the bad heating switch 129 is manually turned on.

As a result of the discrimination at step S21, if the bad heating switch 129 is turned on (YES at step S21), flow of the method proceeds to step S211, where the performance discriminating means 140 discriminates that the heating is bad to cause the display means 150 to indicate that the heating is bad and to terminate the operation.

As a result of discrimination at step S21, if the bad heating switch 129 is not turned on (NO at step S21), flow of the method proceeds to step S22, where the worker checks the noise status of the outdoor unit 20 to determine whether to manually turn on the abnormal outdoor noise switch 130.

As a result of the discrimination at step S22, if the abnormal outdoor noise switch 130 is turned on (YES in step S22), flow of the method proceeds to step S221, where the performance discriminating means 140 discriminates that the noise status of the outdoor unit 20 is bad to cause the display means 150 to indicate that the noise of the outdoor unit is bad and to terminate the operation.

Meanwhile, as a result of the discrimination at step S22, if the abnormal outdoor noise switch 130 is not turned on (NO at step S22), flow of the method advances to step S23, where the worker checks the communication between the indoor unit 10 and the outdoor unit 20 to thereafter determine whether to manually turn on communication switch 130.

As a result of the discrimination at step S23, if the bad communication switch 131 is turned on (YES at step S23), flow of the method proceeds to step S231, where the performance discriminating means 140 discriminates that the communication is bad to cause the display means 150 to indicate that the communication is bad and to thereafter terminate the operation.

Meanwhile, as a result of the discrimination at step S23, if the bad communication switch 131 is not turned on (NO at S23), flow of the method advances to step S24, where the worker manually manipulates the end switch 133 at the second test procedure means 120 to determine whether second test end signal is input to the performance discriminating means 140, and if the signal is not input (NO at S24), step S24 is repeatedly performed.

As a result of the discrimination at step S24, if the second test end signal is input (YES at S24), flow of the method advances to step S25 because each test at the second test procedure means 120 has been sequentially processed and completed. At S25, the performance discriminating means 140 discriminates that the set (indoor+outdoor) put to the test process is good in quality thereof to cause the display means 150 to indicate that the set is of good quality and to terminate the operation.

Meanwhile, although the preferred embodiment of the present invention has been described with reference to sequential progress of each test at the first test procedure means 110 and the second test procedure means 120, the present invention is not intended to be restricted to the above embodiment disclosed, which is considered to be purely exemplary.

It should be understood that the production line for simultaneously assembling the indoor units 10 and the outdoor units 20 can include other test procedures for testing performances of the indoor units 10 and the outdoor units 20 in addition to the first and second test procedure means 110, 120.

As apparent from the foregoing, there is an advantage in the performance testing method of air conditioner thus described according to the present invention in that a production line for simultaneously assembling indoor units and outdoor units and simultaneously testing same performs the testing of the indoor units and outdoor units at the same time, thereby shortening the working hours.

There is another advantage in that investment cost is reduced to a unified system. There is still another advantage in that detecting capability is improved because the indoor units and outdoor units are concurrently tested.

What is claimed is:

1. A method of testing the performance of a separation-type air conditioner, the method comprising the steps of:

pairing a concurrently assembled indoor unit and outdoor unit of a separation-type air conditioner to make a set; and simultaneously testing said set, said step of simultaneously testing comprising the steps of:

connecting a communication line between said indoor unit and said outdoor unit; and connecting a refrigerant pipe between said outdoor unit and a dummy indoor unit.

2. The method of claim 1, further comprising the step of:

before simultaneously testing said set, reading a bar code of said set for identification of said set.

3. The method of claim 1, said step of simultaneously testing said set further comprising the steps of:

before said step of connecting a communication line, performing a first testing procedure, comprising the step of:

measuring the revolution rate of a motor of the indoor unit and checking for leaks of refrigerant gas from the outdoor unit.

4. The method of claim 3, said first testing procedure further comprising the step of:

checking an operational status of the indoor unit.

5. The method of claim 4, said first testing procedure further comprising the step of:

checking the noise state of the indoor unit.

6. The method of claim 5, said step of simultaneously testing said set further comprising the steps of:

after said steps of connecting said communication line and connecting the refrigerant pipe, performing a second testing procedure, comprising the steps of:

measuring the voltage resistance, insulation resistance and earthing resistance of the set.

7. The method of claim 6, said second testing procedure further comprising the step of:

turning the heating remote controller on and testing a low voltage generated from the automatic voltage regulator during the heating operation.

8. The method of claim 7, said second testing procedure further comprising the step of:

turning the cooling remote controller on and measuring the revolution rate of the motor of the outdoor unit, measuring the consumed power, and measuring the temperature difference between the inlet and outlet of the dummy indoor unit.

9. The method of claim 8, said second testing procedure further comprising the step of:

checking the noise state of the outdoor unit.

10. The method of claim 9, said second testing procedure further comprising the step of:

checking the communication between the indoor unit and outdoor unit of said set.

11. The method of claim 10, further comprising the steps of:

before performing said first testing procedure, manually inputting to said performance determining means, a first test start signal;

after said first testing procedure, manually inputting to said performance determining means, a first test end signal;

after said steps of connecting said communication line and connecting the refrigerant pipe and before performing a second testing procedure, manually inputting to said performance determining means, a second test start signal; and after said second testing procedure, manually inputting to said performance determining means, a second test end signal.

12. The method of claim 10, further comprising the step of:

manually inputting, to a performance determining means, a signal of the result of one of the checking or measuring steps of said simultaneous testing of the set.

13. The method of claim 12, further comprising the step of:

when said manually inputted signal is a signal that said set has failed a checking or measuring step, terminating the testing of the set.

14. The method of claim 13, further comprising the step of:

before simultaneously testing said set, reading a bar code of said set for identification of said set.

15. The method of claim 14, further comprising the step of:

after said step of measuring the voltage resistance, insulation resistance and earthing resistance of the set, inputting the measured values of voltage resistance, insulation resistance and earthing resistance to the performance determining means; and comparing the measured values of voltage resistance, insulation resistance and earthing resistance to set-up values identified by the bar-code reading for said set.

16. The method of claim 14, further comprising the step of:

after said step of measuring the revolution rate of the motor of the outdoor unit, measuring the consumed power, and measuring the temperature difference between the inlet and outlet of the dummy indoor unit, inputting the measured values of the revolution rate of the motor of the outdoor unit, the consumed power, and the temperature difference to the performance determining means; and comparing the measured values of the revolution rate of the motor of the outdoor unit, the consumed power, and the temperature difference to set-up values identified by the bar-code reading for said set.

17. A performance testing device for a separation-type air conditioner, the device comprising:

a performance discriminating means for analyzing data of a test set of an indoor unit and an outdoor unit of a separation-type air conditioner;

a bar code reader for inputting bar code data of the test set to the performance discriminating means;

a first test procedure means connected to the performance discriminating means, said first test procedure means comprising:

a gas detector for detecting refrigerant gas leaking from the outdoor unit;

an indoor RPM measurer for measuring the revolution rate of a motor of the indoor unit;

a gas leakage switch for indicating gas leakage;

an operation switch for indicating operational status of the indoor unit;

an abnormal room noise switch for indicating abnormal noise of the indoor unit;

a first test procedure start switch; and a first test procedure end switch;

a second test procedure means connected to the performance discriminating means, said second test procedure means comprising:

an automatic voltage regulator for preventing damage to equipment due to overvoltage or low voltage;

a power meter;

a voltage resistance tester;

an outdoor RPM tester for measuring the revolution rate of a motor of the outdoor unit;

a dummy indoor unit, for connecting to the outdoor unit;

a temperature recorder for measuring the temperature difference between an inlet and outlet of the dummy indoor unit;

a pressure measurer;

a cooling/heating remote controller;

a bad heating switch, for indicating bad heating;

an abnormal outdoor noise switch, for indicating abnormal noise of the outdoor unit;

a bad communication switch, for indicating bad communication between the indoor unit and outdoor unit;

a second test procedure start switch; and a second test procedure end switch; and display means connected to the performance discrimination means.

* * * * *